United States Patent [19]

Brown et al.

[11] 4,325,756

[45] Apr. 20, 1982

[54] FATIGUE RESISTANT NICKEL SUPERALLOY

[75] Inventors: Edgar E. Brown, South Windsor; Duane L. Ruckle, Glastonbury, both of Conn.

[73] Assignee: United Technologies Corporation, Hartford, Conn.

[21] Appl. No.: 115,655

[22] Filed: Jan. 28, 1980

Related U.S. Application Data

[63] Continuation of Ser. No. 970,779, Dec. 18, 1978, abandoned.

[51] Int. Cl.[3] ..... C22C 19/03

[52] U.S. Cl. ..... 148/32.5; 75/170; 75/171

[58] Field of Search ..... 75/170, 171; 148/32, 148/32.5

[56] References Cited

U.S. PATENT DOCUMENTS 2,071,645 2/1937 McNeil ..... 75/170

3,810,754 5/1974 Ford et al. ..... 75/171

3,972,745 8/1976 Yamagishi ..... 75/170

*Primary Examiner*—R. Dean

*Attorney, Agent, or Firm*—C. G. Nessler

[57] ABSTRACT

Disclosed is a nickel base alloy of the gamma-gamma prime type, the composition of which is controlled, to provide a gamma matrix phase in which solid solution hardener elements are minimized, to less than 12.5 weight percent. Preferably, the alloy consists essentially by weight percent of 0.25–9Al, 1–4Ti, 2–6Cb, 0.01–0.1C, at least one material selected from the group consisting by weight percent of 0–6Co, 0–6Mo, 2–7.5Cr, 0–2.5Hf and mixtures thereof, balance nickel. The gamma prime fraction in a heat treated article is in the range 10–45 volume percent. The stacking fault energy is preferably in the range 80–120 ergs/cm$^2$. A gas turbine engine disc made of the material exhibits a three fold increase in fatigue life in the 550–750° C. range, as compared to discs made of typical superalloys in current use, while retaining comparable tensile and stress rupture strength.

6 Claims, No Drawings

FATIGUE RESISTANT NICKEL SUPERALLOY

This is a continuation of application Ser. No. 970,779, filed Dec. 18, 1978, and now abandoned.

BACKGROUND OF THE INVENTION

1. Field of the Invention

The present invention relates to nickel base superalloys, especially wrought alloys of the gamma-gamma prime type having improved resistance to low cycle fatigue at intermediate elevated temperatures in gas turbine disc applications.

2. Description of the Prior Art

The low cycle fatigue capability of nickel base superalloy turbine disc materials has lately assumed a position of overriding importance in the design of gas turbine engines. Previously, a need for high performance engine materials having only a limited life, e.g., 8,500 cycles, placed an emphasis upon improving the tensile and creep properties of disc alloys. But now, with increasing emphasis on longer life 20,000 to 30,000 cycle design life engine components, it has been realized that dynamic (vibratory) properties such as fatigue life have not kept pace with the improvements in static properties such as creep strength, stress-rupture strength and tensile strength. As a result of this imbalance, gas turbine disc stress levels must be kept to a relatively low level to achieve long life, compared to the stress limitation imposed by the static properties alone.

Considerable study of low cycle fatigue in turbine discs has given insight into the stress-strain environment and material behavior. The principal fatigue load is imposed by stresses and temperature gradients which are produced during normal starting and stopping of the engine. For example, a gas turbine low fatigue cycle in an aircraft is defined as one takeoff and landing. (Low cycle fatigue is distinguished from high cycle fatigue which results from substantially lower stresses, such as occur periodically during rotation of the engine; these infrequently are design-limiting.) In general, disc components are limited in notched low cycle fatigue; certain regions affected by stress raisers, such as a hole, become locally plastic during operation, while the remainder of the disc remains elastic. Damage gradually accumulates in the plastic zone about the stress raiser leading to initiation of a microcrack. After initiation, crack growth occurs by crystallographic shear as cycles are further accumulated until the crack assumes a detactable size. The smallest crack that can be detected in situ by standard quality control methods is about 0.030 inch; a detectable crack of any size is usually cause for replacement of the disc.

Heretofore there has been considerable art evidencing improvements in nickel base alloys. Probably the major thrust has been on increasing temperature capability, by developing gamma-gamma prime high strength alloys. Generally, the objective has been to increasingly add alloying elements to increase and make uniform the gamma prime phase while simultaneously strengthening or hardening the gamma matrix phase. In most past instances, alloys which have been used for compressor or turbine discs are modifications of gamma prime strengthened nickel base alloys which were initially developed for use in turbine blades. For example, Waspaloy, Astroloy and IN-100 alloys, currently utilized as turbine disc materials, are all blade alloys slightly modified in chemistry to allow casting in ingot sizes sufficient to produce the much larger discs under forging. The modification of blade alloys has, until recently, proved a most successful method of approaching disc material development, since new and improved turbine blade materials generally have had higher temperature and strength capabilities, properties which have been taken advantage of in the disc application.

In recent years, however, the properties required of discs and blades have diverged significantly. As turbine inlet temperatures increased beyond the capability of superalloys, turbine blades have required air cooling. Since cooling affects the efficiency of the engine, the major emphasis in developing blade alloys has been on higher temperature capability. The cooling air for blades passes through the discs in which the blades are held and this has resulted in turbine disc temperatures seldom exceeding 1200°-1300° F. despite the higher temperatures the blades endure. Therefore, the high temperature (1600°-1800° F.) capability of blade alloys is unnecessary in the turbine discs operating at intermediate temperatures, which range from about 800° F. to about 1300° F., and typically are about 1200° F. in the more demanding applications. However, at the same time, fatigue-causing thermal gradients and resultant thermal strains are produced in the discs in addition to cyclic mechanical stresses. Low cycle fatigue crack initiation and growth have consequently become very significant for discs. The dynamic properties of the blade-derived disc alloys have remained essentially constant despite improvements in strength, creep, and stress rupture capabilities. There is of course variation in fatigue resistance between different alloys, depending on their composition and processing method. However, the difference in fatigue resistance solely due to composition is not great compared to the three-fold or greater advance which is needed. Attempts have been made to improve the low cycle fatigue properties of alloys through thermomechanical processing—controlled sequencing of forging and heat treatment—which will, for example, vary the grain size. While finer grain size can improve fatigue life, a corollary can be an unacceptable reduction in creep strength. In addition, powder metallurgical techniques have been used either to avoid segregation during ingot formation in complex alloys having improved properties or to minimize grain size. Processing techniques necessary to achieve fine grain size or form powder metal objects require additional steps, equipment, and controls, which can be costly.

SUMMARY OF THE INVENTION

It is an object of the present invention to provide an article made of a wrought nickel base superalloy of the gamma-gamma prime type which exhibits much improved low cycle fatigue properties, as compared to prior art gamma-gamma prime disc alloys, while maintaining acceptable strength and stress rupture properties.

According to the invention, a reduction in gamma phase hardener content substantially increase fatigue life. This is based on the discovery that gamma phase properties control fatigue life and that minimization of hardener content will improve gamma phase fatigue resistance. As used herein "hardener" refers to a solid solution element which strengthens the gamma phase. Typical hardener contents are less than 12.5 percent, and preferably they are less than 6 percent. As desired, the hardener chromium is preferentially added to a limited extent up to 6% to provide improved oxidation resistance to an alloy having no other gamma hardeners. Also, iron, which is not treated as a significant hardener within the scope of the invention, is substituted for nickel on an equal weight basis up to 40 percent to lower alloy cost. Other optional elements include up to 2.5 weight percent of metal selected from hafnium and/or zirconium.

It is further in accord with the invention that useful alloys have stacking fault energies greater than 30 ergs per square centimeter and preferably, about 100 ergs per square centimeter or greater, to provide improved fatigue resistance.

An alloy composition in accord with the invention is found to consist essentially of, by weight, 0.25 to 9.0% Al, 0 to 4.0% Ti, 0 to 6.0% Cb, 0.01 to 0.10% C, and at least one material selected from the group consisting of 0–6% Co, 0–6% Mo, 2–7.5% Cr, 0–2.5% Hf and mixtures thereof balance essentially nickel and incidental impurities. In this composition, the content of gamma prime formers, aluminum, titanium and columbium, are varied to provide the strength characteristics required. The article has a composition and heat treatment which provides between 10 and 45 volume percent gamma prime. An even more preferred composition of the invention useful as a disc material consists essentially of, by weight, 3.0 to 4.0% Al, 0 to 3.0% Ti, 0 to 4.0% Cb, 0.03 to 0.06% C, 4.0 to 6.0% Cr, 0 to 2.0% Hf, balance essentially nickel and incidental impurities. The invention provides a wrought nickel base superalloy which has at least a three-fold increase in low cycle fatigue strength. This improvement is provided with substantial retention of strength and stress rupture properties in the 1200° F. (650° C.) range characteristic of gas turbine discs. And it compares the invention alloy favorably with prior art disc materials such as Waspaloy.

In addition to its improved low cycle fatigue properties in the 1000°–1400° F. (550°–750° C.) range, the nickel base alloy of the invention is advantageous in several other ways. Due to the absence of solid solution hardener elements in the composition, the alloy is not only low in cost but also exhibits improved forgeability compared to prior art materials. In addition, a significant reduction in the melt segregation problem is expected as a result of the low alloying content. This feature may totally eliminate the need for powder metallurgy melting and consolidation techniques now frequently required to fabricate complex turbine disc alloys.

These and other objects, characteristics, and features of the invention will become evident from the preferred embodiment description which follows.

DESCRIPTION OF THE PREFERRED EMBODIMENT

The present invention resulted from a completely different approach to the problem of increasing fatigue resistance to low cyclic stresses and involves two discoveries: First, the dynamic deformation characteristics of such alloys at intermediate temperatures are controlled predominantly by the deformation characteristics of the gamma matrix phase, rather than the gamma prime phase or both phases. Second, by minimizing the amount of solid solution hardener elements in the gamma matrix, the low cycle fatigue properties can be maximized. Accordingly, in the present invention, such powerful solid solution hardeners as chromium, cobalt, molybdenum, tungsten, tantalum and the like are deleted or minimized to levels at which their adverse effect on fatigue properties is decreased but other benefits are adequately retained. On the other hand, the gamma prime formers, such as titanium, aluminum, columbium, magnesium, and the like, are maintained and adjusted to provide the strength and stress rupture strength desired for a particular service application. To this end, a typical nickel base alloy of the present invention consists essentially of, by weight, 0.25% to 9.0% Al, up to 4.0% Ti, up to 6.0% Cb, 0.010% to 0.10% C, balance essentially nickel and incidental impurities. (In the foregoing and following compositions it should be understood that minor elements contained as impurities in the major constituents of an inventive alloy, due to the constituents being commercial or recycled products, will not be violative of the spirit of the invention herein.)

Table 1 compares hardeners and gamma prime formers of some typical disc alloys to alloy A and alloy B which conform to the present invention. As is apparent, little of the solid solution hardener elements normally included in nickel base disc alloys for high temperature strength is present in the inventive compositions. If desired to reduce cost, iron can replace nickel on a one to one weight basis in amounts not exceeding 40 weight percent iron, but preferably less than 35 weight percent. Although iron may be classified as a solid solution hardener, it is relatively weak in this regard as compared to others such as tungsten and molybdenum and for purposes of the claimed invention, iron is not considered a hardener. Therefore it can be tolerated in the aforementioned range with no significant adverse affect upon fatigue properties, as shown by way of example hereafter.

TABLE 1

Weight Percent of Some Elements in Nickel Base Disc Alloys

| | Hardeners | | | Gamma Prime Formers | | | | |
|---|---|---|---|---|---|---|---|---|
| | Cr | Co | Mo | Ti | Al | Cb | Hf | Fe |
| Waspaloy | 19.5 | 13.5 | 4.0 | 3 | 1.4 | — | — | — |
| Astroloy | 15.0 | 17.0 | 5.0 | 3.5 | 4.0 | — | — | — |
| IN-100 | 9.0 | 15.0 | 3.0 | 4.8 | 5.5 | — | — | — |
| Alloy A | — | 5.0 | — | 1.5 | 0.5 | 5.0 | — | 33.0 |
| Alloy B | 5.0 | — | — | 1.0 | 4.0 | 2.0 | 0.8 | — |

In a similar vein, cobalt in amounts not exceeding 6 weight percent may replace nickel on a one to one basis providing benefits in alloy tensile properties. Nonetheless, under few circumstances will molybdenum, tungsten, tantalum and other refractory elements be included in the composition. Whether or not some of these solid solution hardeners should be added must be determined by balancing the strength benefit obtained from such addition against the adverse impact upon fatigue properties. For the refractory elements, the scale generally tips significantly in favor of not including them in the composition.

The gamma prime formers are elements which combine to produce the gamma prime phase on solidification and heat treatment. The morphology, or distribution in the microstructure, of gamma prime is dependent on the quantity of forming elements, and solidification, heat treatment, and mechanical processing. The useful alloys of the present invention will typically have gamma prime volume percents (of the total alloy volume) of greater than 10–15 and less than about 45. Most preferably they will have gamma prime volumes between 20 and 30 percents. Of course, the remainder of the alloy volume is gamma.

An inventive alloy whose composition was selected in accordance with the above guidelines is designated alloy A and consists essentially of, by weight, 0.5% Al, 5.0% Cb, 1.5% Ti, 33.0% Fe, 5.0% Co, 0.03% C, balance nickel. Four ingots of the selected chemistry were cast and press forged into 15 inch diameter by one inch thick discs by a two step processing sequence, resulting in an as-forged grain size of ASTM 4–5. Heat treatment studies of segments of a disc revealed that a one hour 1575° F. solution treatment followed by an aging sequence of 1325° F. for eight hours plus 1150° F. for eight hours provided optimum room temperature and 1200° F. tensile strength properties. The remaining discs were heat treated thusly and evaluated in tensile and low cycle fatigue tests along with a Waspaloy alloy of nominal composition, by weight, 19.5% Cr, 13.5% Co, 3.0% Ti, 1.4% Al, 4.0% Mo, 0.08% C, 0.08% Zr, 0.008% B, balance nickel. The results are shown in Tables 2 and 3.

The tensile properties shown indicate ultimate and yield strength capability of Alloy A is generally superior to the Waspaloy material. Note that Alloy A exhibits a much higher fracture ductility as indicated by reduction of area. High fracture ductility is thought to be one manifestation of slip dispersal and is expected to be reflective of advantageous low cycle fatigue. This prediction is borne out in the notched low cycle fatigue tests at 1000° F. wherein the results indicate a six-to-one improvement in cyclic life for Alloy A.

Stacking fault energy is a material characteristic determinable with the use of the electron microscope. Generally, the addition of elements to nickel has the effect of lowering stacking fault energy. See, for example, Ford et al U.S. Pat. No. 3,810,754 which is hereby incorporated by reference. On the other hand increased stacking fault energy is correlated with improved fatigue properties, according to the following hypothesis. For temperatures below the 1400° F. range fatigue failure is associated with planar slip and therefore improved properties are to be expected when the nature of the material is such that fatigue induced deformation can be generally distributed.

TABLE 2

Comparative Tensile Properties of Disc Alloys

| Material | Test Temperature | Ultimate Tensile Strength (ksi) | Yield Strength 0.2% Offset (ksi) | Percent Elongation | Percent Reduction in Area |
|---|---|---|---|---|---|
| Alloy A | Room | 210 | 165 | 20 | 45 |
| | 1200° F.–(650° C.) | 160 | 140 | 20 | 50 |
| Alloy B | Room | 205 | 130 | 18 | 40 |
| | 1200° F.–(650° C.) | 170 | 110 | 13 | 26 |
| WASPALOY | Room | 200 | 135 | 15 | 18 |
| | 1200° F.–(650° C.) | 178 | 115 | 17 | 17 |

TABLE 3

Comparative Notched Specimen Low Cycle Fatigue Properties at 1000° F. (540° C.)

| Material | Stress (ksi) | Stress Concentration Factor ($K_t$) | Cycles to a 1/32-Inch Crack Indication |
|---|---|---|---|
| Alloy A | 40 ± 50 | 2 | 200,000+ (Runout) |
| | 40 ± 60 | 2 | 38,000 |
| | 40 ± 60 | 2 | 26,000 |
| Alloy B | 40 ± 50 | 2 | 70,000 |
| | 40 ± 60 | 2 | 25,000 |
| WASPALOY | 40 ± 50 | 2 | 33,000 |
| | 40 ± 50 | 2 | 24,000 |
| | 40 ± 60 | 2 | 12,000 |
| | 40 ± 60 | 2 | 4,000 |

Increased stacking fault energy means that the partial dislocations are in closer proximity. Therefore, cross slip is more likely and fatigue properties are improved under the resultant more uniform deformation.

Calculation of the stacking fault energy by electron microscope data indicates the gamma matrix of Waspaloy is on the order of 30 ergs per square centimeter. Other alloys, such as Astroloy have analagous gamma matrix stacking fault energies. In comparison, the stacking fault energy for alloy A is on the order of 100 ergs per square centimeter. While this is reflective of reduced high temperature properties, under the typical 1200° F. (650° C.) maximum operating temperature range of discs, it is found, as described herein, that alloys with such energies are quite useful.

Although relevant oxidation resistance data is not shown, it is noted that alloy A was inferior to Waspaloy material in such tests. Of course, in many service applications, lowered oxidation resistance may be tolerated or prevented by suitable coatings or surface treatment. However, in the situation such as a gas turbine disc application, where better inherent oxidation resistance is desired, the present invention provides for the inclusion of chromium in the alloy composition in amounts not exceeding 7.5 weight percent, preferably 2.0 to 6.0 weight percent. Although chromium is a solid solution hardener to be avoided when not required, it has been found that when present in the amounts specified, the fatigue properties of the alloy are harmed only slightly and, at least for turbine discs, this slight diminution in fatigue properties can be accommodated. In addition to providing the oxidation resistance required in turbine disc applications, chromium additions in the specified amounts also reduce the solubility of the gamma phase for the gamma prime forming elements, such as aluminum, titanium and columbium, desirably causing more of the strengthening phase to precipitate for a given amount of gamma-prime formers. Generally, chromium will be added in amounts which provide the desired oxidation resistance while effecting only a minimal decrease in the gamma matrix stacking fault energy. An alloy which has been found to fulfill this and the other above-stated guidelines consists essentially of, by weight, 4.0% Al, 2.0% Cb, 1.0% Ti, 5.0% Cr, 0.05% C, 0.8% Hf, balance essentially nickel. In this composition, designated alloy B, a minimum of chromium is added in order to provide oxidation resistance. Other than chromium, no solid solution elements appear in the alloy formulation. The aluminum, titanium and columbium contents have been adjusted to yield room-temperature properties similar to those of the Waspaloy alloy, as shown in the Table 2. Low cycle fatigue properties are reduced somewhat relative to alloy "A" but are still superior to Waspaloy by a factor of 3, as shown in Table 3.

Of course, those skilled in the art will recognize that other elements sometimes found in nickel base alloys can be present in the alloys of the present invention without adversely affecting the fatigue properties thereof. For example, boron in amounts up to 0.3 weight percent may be present for its usual grain boundary strengthening effect. Carbon in amounts up to 0.10 weight percent may be added to promote formation of beneficial grain boundary carbide phases.

Although the alloys of the invention exhibit inferior high temperature creep resistance as compared to Waspaloy material and other prior art alloys, this should not be a severe problem in advanced long-life turbine engines which involve maximum disc operating temperatures of only about 1200° F.

The wrought nickel alloys mentioned herein are typically characterized with respect to the volume percent of gamma prime. Wrought nickel alloys analagous to Waspaloy and useful within the scope of the invention's objects are found to have gamma prime ranging from 12 to 40 volume percent. At higher volume percents than 40, the techniques of the invention would still be applicable, but it is felt that when hardeners are substantially deleted in accord with the preferred practice of the invention, the dynamics of gamma prime formation would be insufficiently controllable and an overly coarse structure would result.

The alloys of the present invention have been characterized with respect to being converted into useful shape by a conventional forging process such as is used for current alloys like Waspaloy and Astroloy. While the inventive alloys are particularly forgeable they also could be converted into useful shapes such as gas turbine discs by powder metallurgy processes for economic advantage, or by any other process applicable to conventional alloys.

Those skilled in the art will also recognize that other changes, omissions and additions in the form and detail of the illustrated embodiments may be made without departing from the spirit and scope of the invention.

Having thus described typical embodiments of our invention, that which we claim as new and desire to secure by Letters Patent of the United States is:

1. As an article of manufacture, a gas turbine disc having improved fatigue resistance in the 550°–750° C. range, said disc being formed of a gamma-gamma prime fatigue resistant nickel base alloy consisting essentially by weight percent of 0.25–9 Al, 1–4 Ti, 2–6 Cb, 0.01–0.1 C, and at least one material comprising 5–13 weight percent, said material selected from the group consisting by weight percent of 0–6 Co, 0–6 Mo, 2–7.5 Cr, 0–2.5 Hf and mixtures thereof balance nickel, the article further having a composition and heat treatment which provides between 10 and 45 volume percent gamma prime.

2. The article of claim 1 further having a stacking fault energy of about 80–120 ergs per square centimeter.

3. As an article of manufacture, a gas turbine disc having improved fatigue resistance in the 550°–750° C. range, said disc being formed of a nickel base alloy consisting essentially by weight percent of 0.25–9 Al, 1–4 Ti, 2–6 Cb, 0.01–0.1 C, 0.5–1.5 Hf, and 2–13 gamma phase hardener selected from the group consisting of Cr, Co, Mo, and mixtures thereof, said disc having a composition and heat treatment which provides 10–45 volume percent gamma prime phase, and a gamma phase stacking fault energy substantially greater than 30 ergs per square centimeter.

4. The article of claim 1 in which the alloy has iron substituted for nickel in amounts up to 40 weight percent.

5. The article of claim 1 wherein the alloy consists essentially by weight percent of 4 Al, 2 Cb, 1 Ti, 5 Cr, 0.05 C, 0.8 Hf, balance Ni.

6. The article of claim 1 wherein the alloy consists essentially by weight percent of 0.5 Al, 5 Cb, 1.5 Ti, 33 Fe, 5 Co, 0.03 C, balance Ni.

* * * * *